United States Patent [19]

Nagasaka

[11] Patent Number: 5,013,087

[45] Date of Patent: May 7, 1991

[54] SEAT HAVING ADJUSTABLE LUMBAR SUPPORT

[75] Inventor: Youetsu Nagasaka, Fujisawa, Japan

[73] Assignee: Shiroki Corporation, Fujisawa, Japan

[21] Appl. No.: 384,616

[22] Filed: Jul. 25, 1989

[30] Foreign Application Priority Data

Mar. 31, 1989 [JP] Japan ..... 1-38046

[51] Int. Cl.[5] ..... A47C 7/40

[52] U.S. Cl. ..... 297/284; 297/460

[58] Field of Search ..... 297/284, 363, 364, 460, 297/361, 353

[56] References Cited

U.S. PATENT DOCUMENTS

| | | | |
|---|---|---|---|
| 3,880,463 | 4/1975 | Shephard et al. | 297/284 |
| 4,465,317 | 8/1984 | Schwarz | 297/284 |
| 4,534,592 | 8/1985 | Hattori | 297/284 |
| 4,623,193 | 11/1986 | Lieker | 297/284 |
| 4,730,871 | 3/1988 | Sheldon | 297/284 |
| 4,811,986 | 3/1989 | Hattori et al. | 297/284 |

FOREIGN PATENT DOCUMENTS

| | | | |
|---|---|---|---|
| 696502 | 10/1964 | Canada | 297/284 |
| 411596 | 11/1966 | Switzerland | 297/284 |
| 640877 | 1/1979 | U.S.S.R. | 297/284 |
| 762304 | 11/1956 | United Kingdom | 297/284 |

*Primary Examiner*—Jose V. Chen

*Attorney, Agent, or Firm*—Schwartz & Weinrieb

[57] ABSTRACT

Disclosed is a seat for an automobile or the like. The seat includes a seat cushion; a seat back connected to the seat cushion, a space being formed within a lower portion of the seat back; a rod rotatably interposed between opposed side frames of the seat back; a hip support secured to an intermediate portion of the rod and disposed within the space provided in the seat back; a support board disposed upon a support plate provided within the hip support, in such a manner as to be vertically slidable; a drum provided upon an upper portion of the support plate; a guide pulley provided upon a lower portion of the support plate in such a manner as to be swingable; a cable trained between the drum and the guide pulley and driven by means of the rotation of the drum, the support board being connected to a substantially intermediate portion of the cable; a spring for biasing the guide pulley in the direction of increasing the tension of the cable; a first operation handle for rotating the drum by means of a flexible wire; and a second operation handle for rotating the rod by means of a brake mechanism.

13 Claims, 9 Drawing Sheets

SEAT HAVING ADJUSTABLE LUMBAR SUPPORT

FIELD OF THE INVENTION

The present invention relates to a seat for an automobile or the like and, more particularly, to a seat having a hip support for supporting the hip region, that is the lumbar vertebra, L-3 to L5, of an occupant of a vehicle.

BACKGROUND OF THE INVENTION

Seats of the aforenoted type are disclosed in Japanese Utility Model Laid-Open Nos. 174462/1986 and 101850/1984.

The former Japanese Utility Model Laid-Open No. 174462/1986 discloses an arrangement in which a space is provided within a lower portion of a seat back, a hip support being accommodated within the space in such a manner as to be forwardly inclinable with its lower portion serving as a fulcrum, and when an occupant assumes a seated position in which his hip region is moved forwardly, the hip support is inclined forwardly so as to project outwardly from a front surface of the seat back, thereby allowing the occupant's hip to be supported by means of this projecting portion. However, with this arrangement, if the occupant feels that the support of his hip region is insufficient, it is necessary for him to rise up and seat himself again after inclining the hip support to a greater extent in the forward direction.

In the latter Japanese Utility Model Laid-Open No. 101850/1984, an arrangement is disclosed in which a space is provided within a lower portion of a seat back, a hip support being disposed within the space in such a manner as to be rotatable back and forth with an upper portion thereof serving as a fulcrum, and a seat plate is connected to a lower portion of this hip support by means of a hinge in such a manner as to be movable back and forth upon the seat cushion. With this arrangement, the occupant is seated upon the seat cushion by means of the seat plate. Accordingly, when he feels that the support of his hip is insufficient, it is necessary for the occupant to rise up, move the hip support forwardly by pulling the seat plate in the forward direction, and then seat himself again.

Thus, with the above-described examples of the prior art, if the occupant rises up, he can adjust the position of the hip support in a back and forth mode; however, he cannot make any adjustments in the vertical direction. In addition, no adjustments can be made by the seat occupant while seated. Still further, while the hip support is designed to press, engage or support the lumbar vertebrae (L-3 to L-5), the position of the lumbar vertebrae (L-3 to L-5) differs depending upon the physical constitution of the occupant. Thus, the conventional apparatus have a drawback in that it is impossible to obtain appropriate support for the hip region of the occupant as a function of the physical constitution of the occupant.

OBJECTS OF THE INVENTION

Accordingly, an object of the present invention is to provide a seat which is capable of achieving adjustment of the vertical position of the hip support, thereby overcoming the above-described drawback of the prior art.

Another object of the present invention is to provide a seat which allows an occupant of a vehicle to adjust the back-and-forth position of the hip support while being seated.

Still another object of the present invention is to provide a seat which allows an occupant of a vehicle to adjust the vertical position of the hip support while being seated.

SUMMARY OF THE INVENTION

To these ends, in accordance with the present invention, there is provided a seat comprising a seat cushion; a seat back connected to the seat cushion, a space being formed within a lower portion of the seat back; a rod rotatably interposed between opposing side frames of the seat back; a hip support secured to an intermediate portion of the rod and disposed within the space provided within the seat back; a support board disposed upon a support plate provided within the hip support, in such a manner as to be vertically slidable; a drum provided upon an upper portion of the support plate; a guide pulley provided upon a lower portion of the support plate in such a manner as to be swingable; a cable trained between the drum and the guide pulley and driven by means of the rotation of the drum, the support board being retained by means of a substantially intermediate portion thereof; a spring for biasing the guide pulley in the direction of increasing the tension of the cable; a first operation handle for rotating the drum by means of a flexible wire; and a second operation handle for rotating the rod by means of a brake mechanism.

BRIEF DESCRIPTION OF THE DRAWINGS

The other objects, features and advantages of the present invention will become more apparent from the following detailed description of the invention when read in conjunction with the accompanying drawings, in which like reference characters designate like or corresponding parts throughout the several views, and wherein.

DESCRIPTION OF THE PREFERRED EMBODIMENTS

Figure 1:
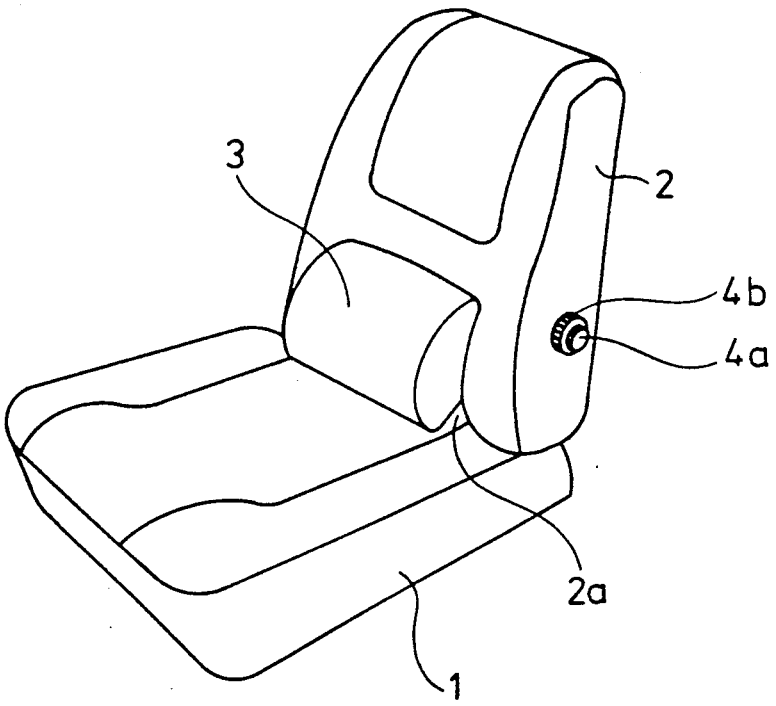
FIG. 1 is a perspective view of an overall arrangement of a seat constructed in accordance with an embodiment of the present invention.

Referring now to FIG. 1, a description will be given of an overall arrangement of a seat in accordance with an embodiment of the present invention. A space 2*a* is formed within a lower portion of a seat back 2 which is connected to a seat cushion 1, a hip support 3 being disposed within this space 2*a*. A first operation handle 4a is designed to adjust the vertical position of a support board (which will be described later) disposed within the hip support 3, while a second operation handle 4b is designed to adjust the back-and-forth position of the hip support 3.

Figure 2:
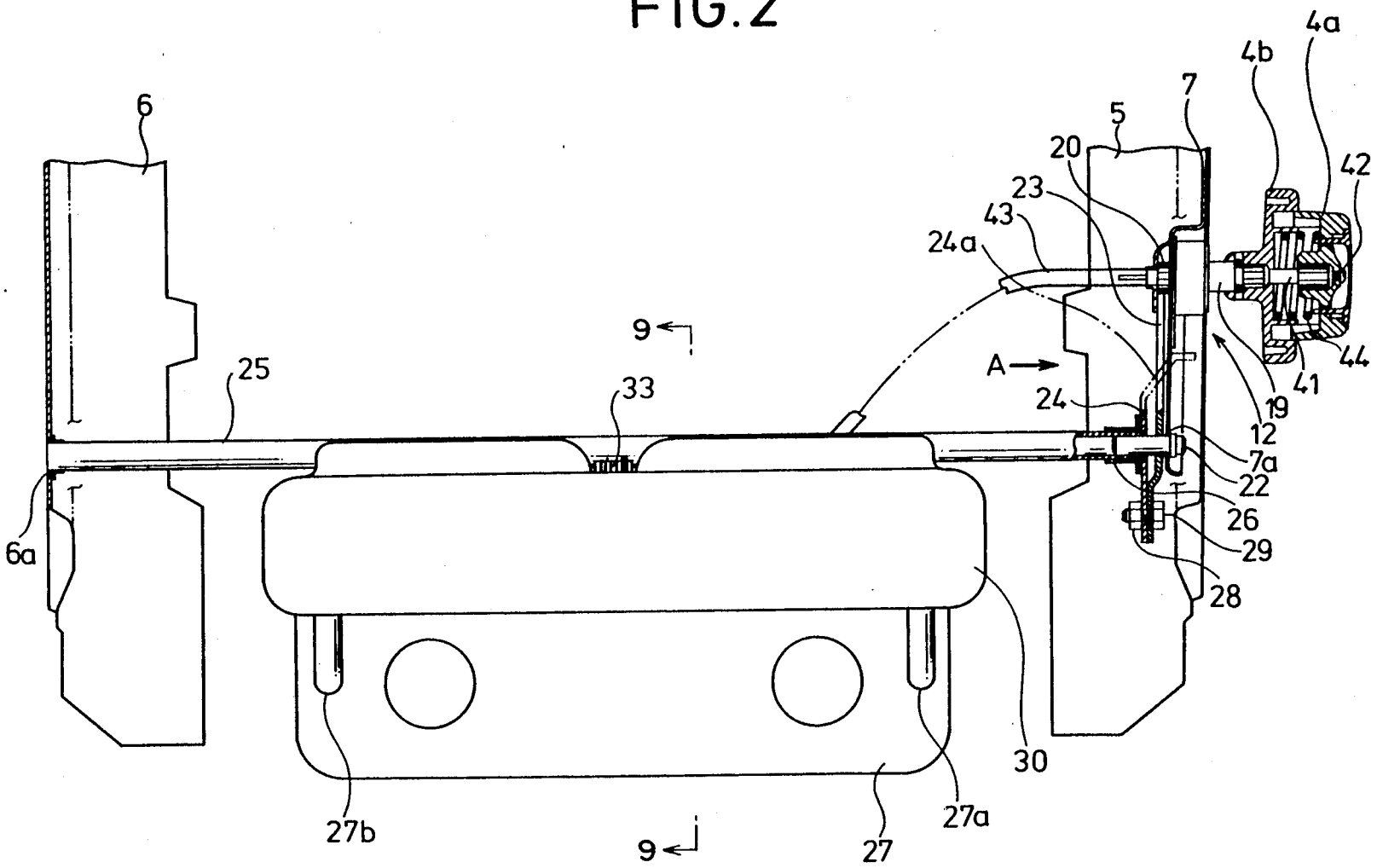
FIG. 2 is a partially cut-away front elevational view illustrating an essential portion of the seat embodiment shown in FIG. 1.
Figure 3:
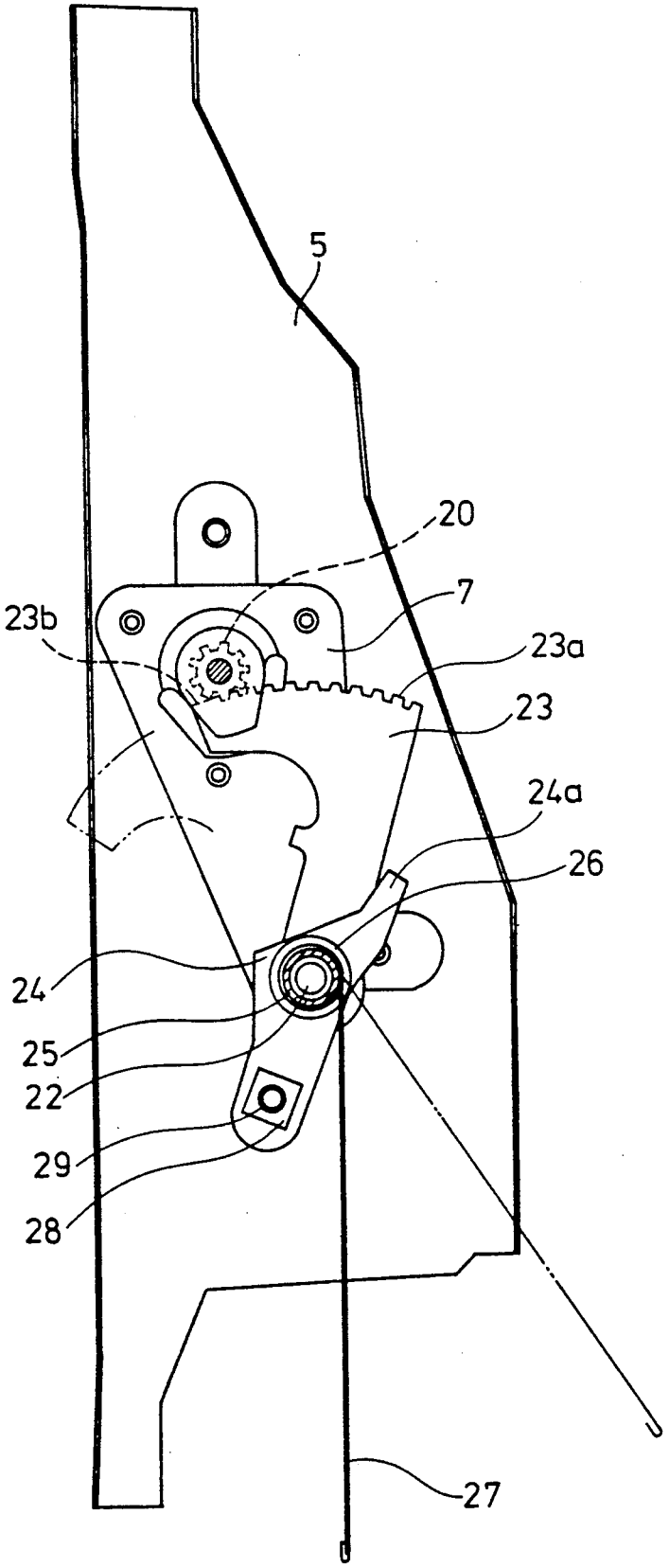
FIG. 3 is a view taken in the direction of the arrow A shown in FIG. 2.
Figure 4:
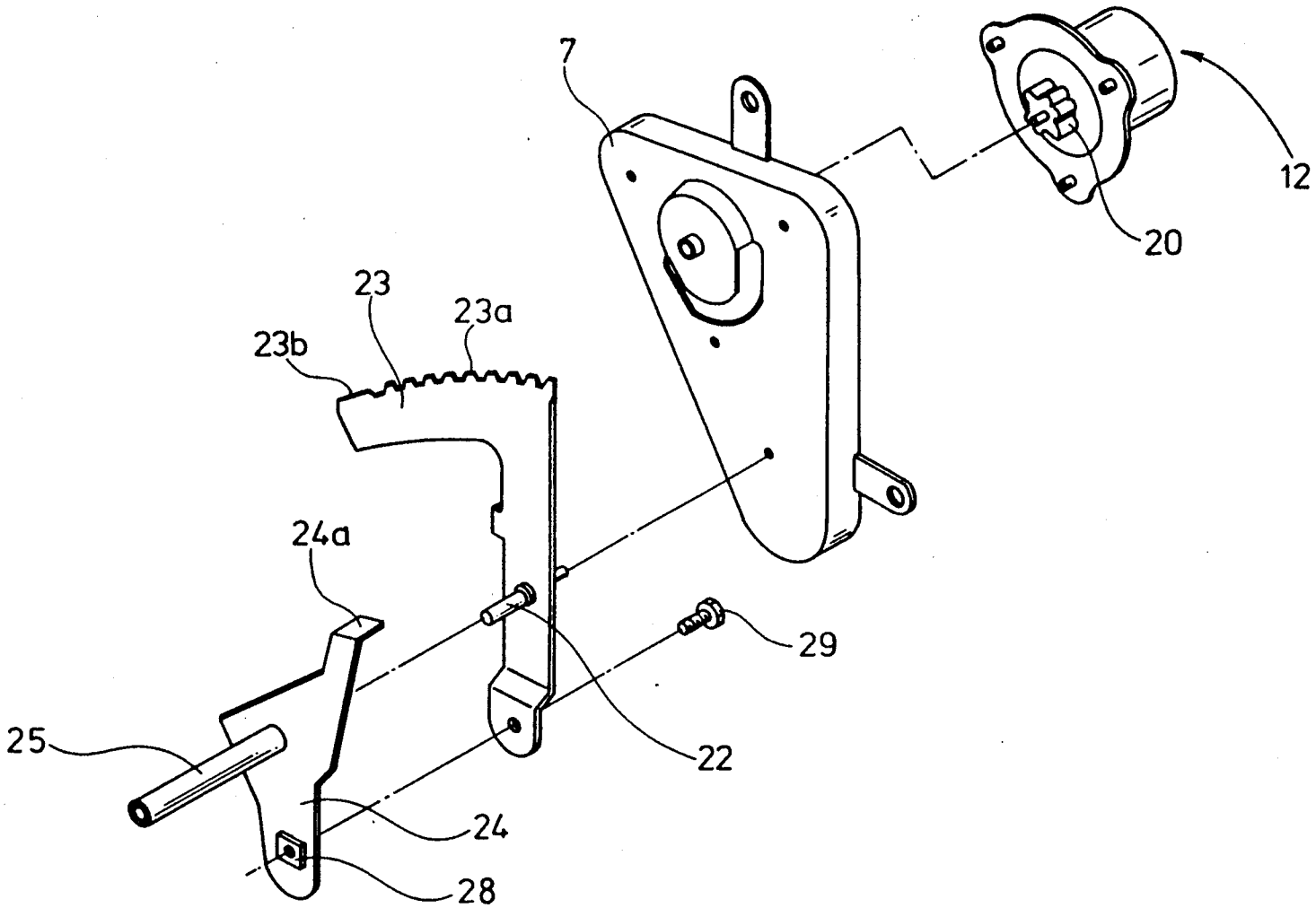
FIG. 4 is an exploded perspective view illustrating an essential operating portion of the adjustment mechanism shown in FIG. 3.

Referring now to FIGS. 2–4, a description will be given of a mechanism for adjusting the position of the hip support 3 in its back and forth mode. Side frames 5, 6 are respectively provided upon opposite side portions of the seat back 2, and a brake mechanism 12 is attached to one side frame 5 by means of a baseplate 7.

Figure 5:
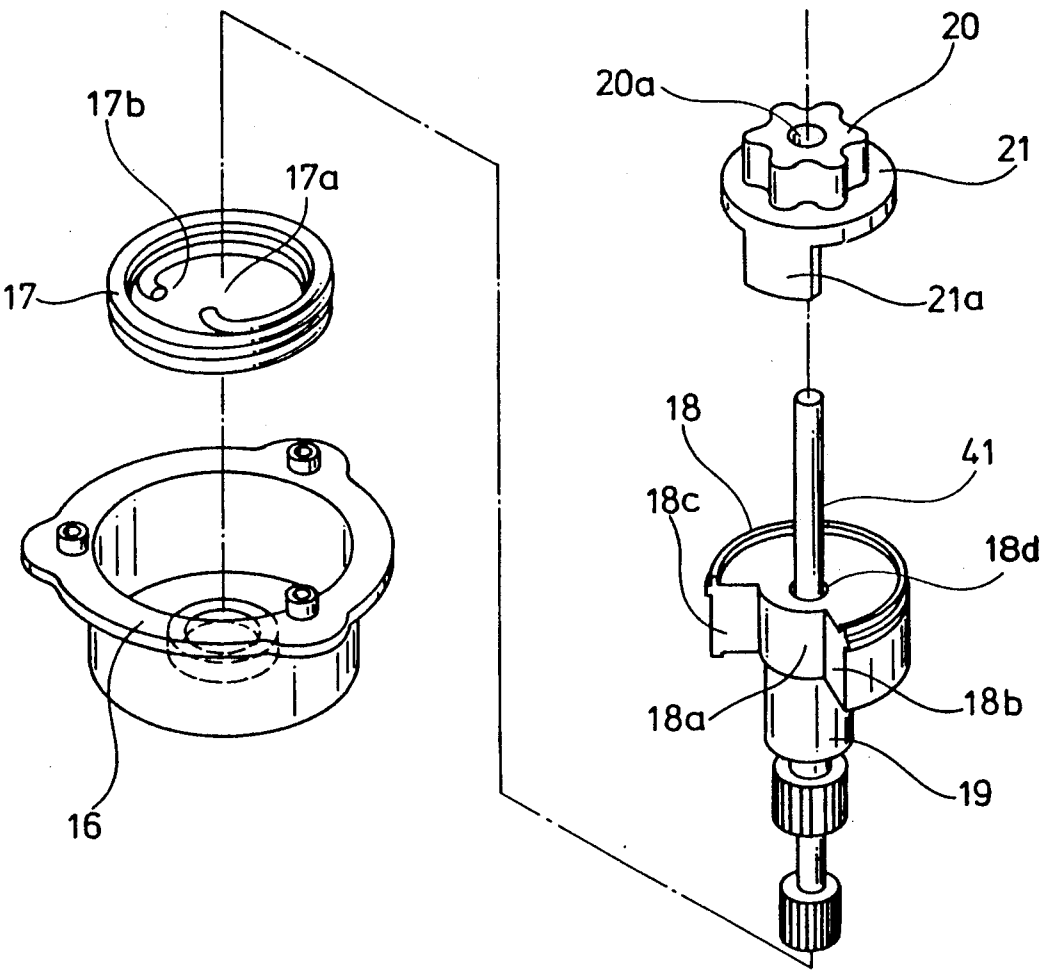
FIG. 5 is an exploded perspective view illustrating the brake mechanism shown in FIG. 4.

A description will now be given of the brake mechanism 12 with reference to FIGS. 5–7. A torsion spring 17 is disposed inside a brake housing 16, which is secured to the baseplate 7, in such a manner as to be brought into pressure contact with an inner peripheral wall of the brake housing 16. A core 18 provided with a notch 18a is rotatably inserted inside the torsion spring 17. In addition, an outer handle shaft 19 on which the second operation handle 4b is mounted is integrally secured to this core 18. Furthermore, a pawl portion 21a of a stopper plate 21 integrally formed with a pinion 20 is inserted in the space of the notch 18a of the core 18 between hook portions 17a, 17b of the torsion spring 17. Moreover, a through-hole 18d and a through-hole 20a are respectively provided axially in the core 18, 19 and the pinion 20. An inner handle shaft 41 which will be described later is loosely inserted in these through-holes 18d, 20a in such a manner as to be axially movable. Hence, the pinion 20 is rotatable about the inner handle shaft 41.

Figure 6:
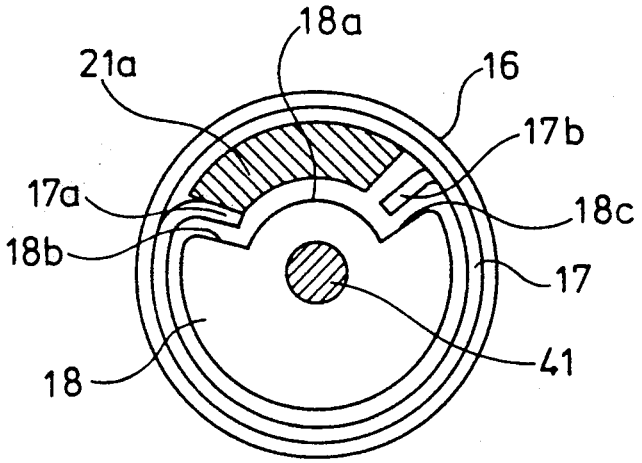
FIGS. 6 and 7 are diagrams illustrating the operation of the brake mechanism shown in FIG. 5.
Figure 7:
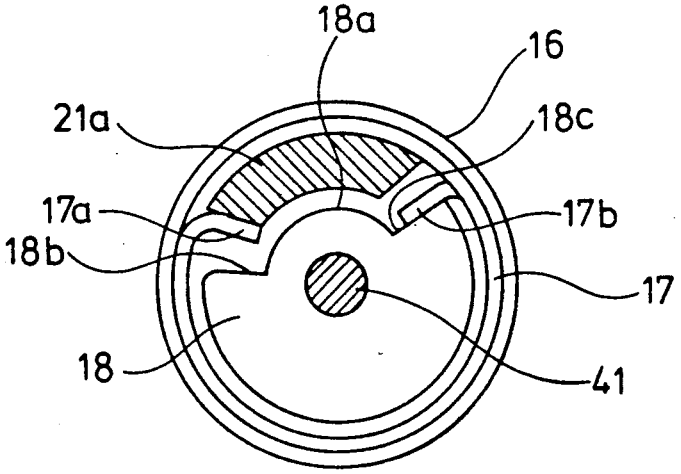
Figure 8:
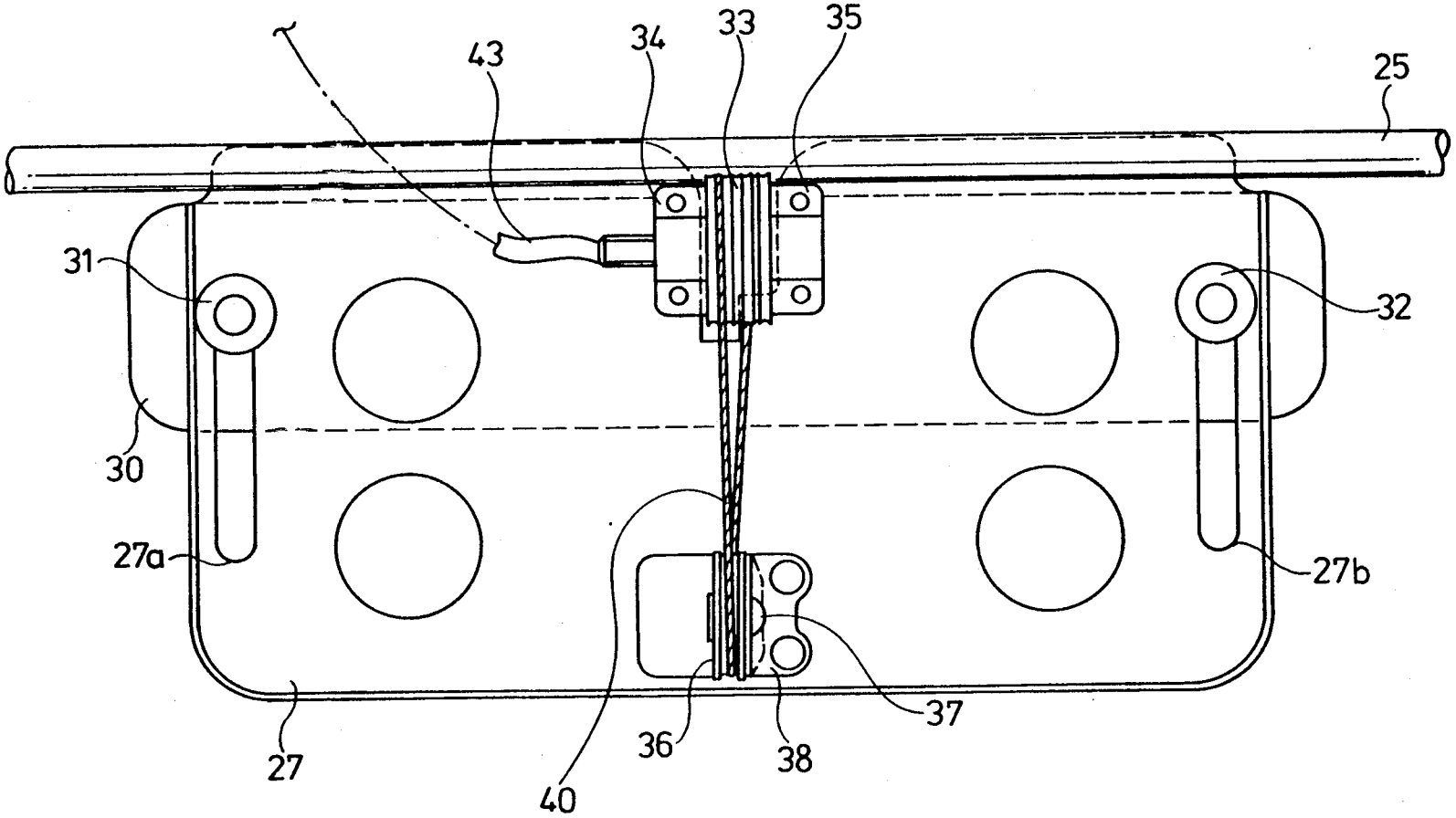
FIG. 8 is a rear view of the support board and its peripheral portions shown in FIG. 2.
Figure 9:
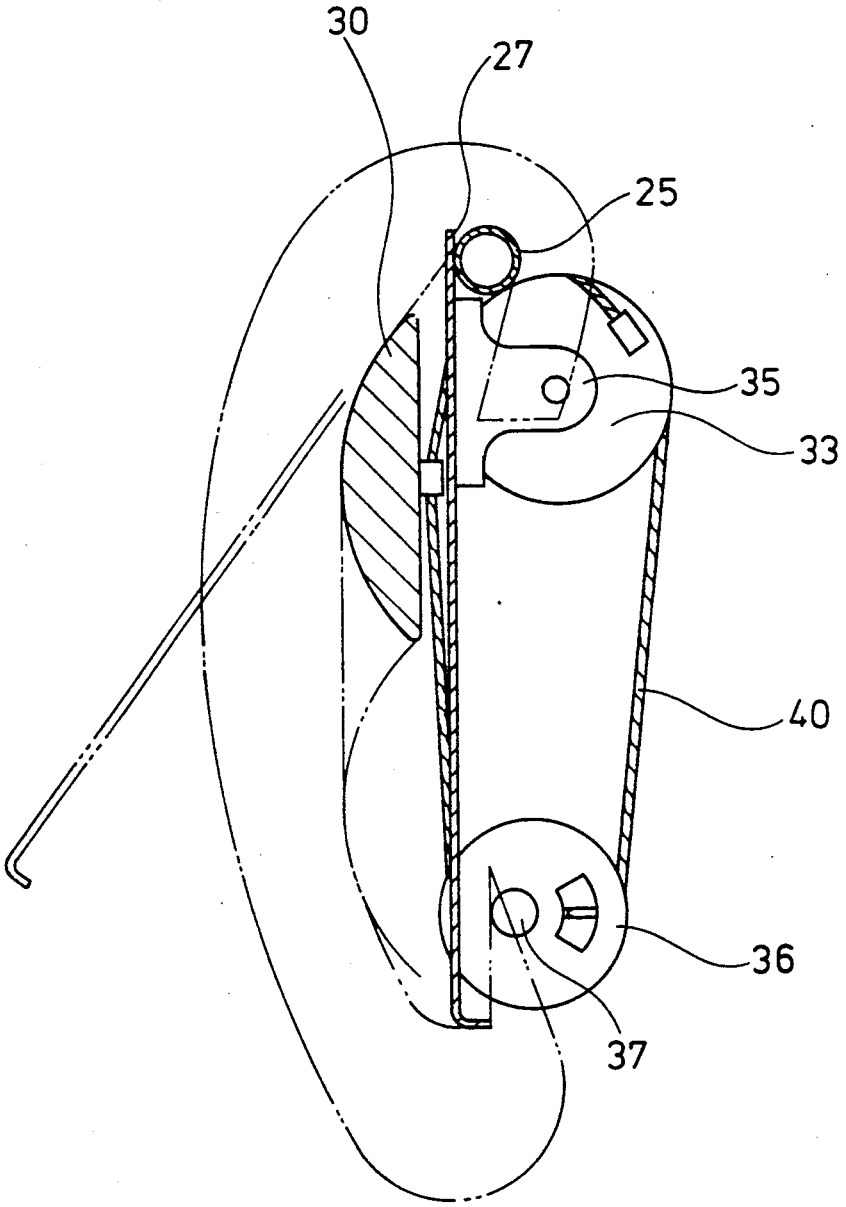
FIG. 9 is a cross-sectional view taken along the line 9—9 of FIG. 2.

Accordingly, when a rotational force is applied from the pinion 20 side, the pawl portion 21a is brought into contact with the hook portion 17a or 17b of the torsion spring 17 and biases the same, as shown in FIG. 6, so as to act in such a manner as to expand the outside diameter of the torsion spring 17. For this reason, the pressure-contacting force acting between the torsion spring 17 and the brake housing 16 increases, with the result that the hook portions 17a, 17b do not move, thereby preventing the rotation of the pinion 20. Meanwhile, when an operating force is applied from the second operation handle 4b (outer handle shaft 19) side, since the hook portion 17a or 17b of the torsion spring 17 is subjected by means of a side end portion 18b or 18c of the core 18 to a force acting in the direction of shrinking the outside diameter of the torsion spring 17, as shown in FIG. 7, the pressure-contacting force acting between the torsion spring 17 and the brake housing 16 decreases. This allows the rotation of the outer handle shaft 19 to start, and the torsion spring 17 rotates as a result of being pushed by means of the outer handle shaft 19 and core 18, with the result that the pawl portion 21a rotates as a result of being pressed by means of the hook portion 17a or 17b of the torsion spring 17. Hence, the pinion 20 also rotates.

Referring back to FIGS. 2–4, a bore 7a is provided within a lower portion of the baseplate 7. A shaft 22 is rotatably disposed within this bore 7a. A driven gear 23 is secured to the shaft 22, and a gear portion 23a thereof meshes with the pinion 20. A non-gear portion 23b is formed at one end portion of the gear portion 23a of this driven gear 23 and serves as a stopper for the rotation of the driven gear 23.

A link plate 24 is rotatably mounted upon the shaft 22, a stopper arm 24a capable abutting against a side surface of the baseplate 7 and driven gear 23 being formed at one rotating end portion thereof. A rod 25 is rotatably interposed between the side frames 5, 6. In other words, one end of the rod 25 is rotatably mounted upon the shaft 22, while the other end thereof is rotatably disposed within a bore 6a provided within the side frame 6. The end of the rod 25 on the side frame 5 side is secured to the link plate 24 by means of a rod spacer 26. In addition, an intermediate portion of the rod 25 is disposed within the space 2a provided within the seat back 2, a support plate 27 constituting a core portion of the hip support 3 being secured to this intermediate portion of the rod 25.

A weld nut 28 is secured to the other pivoting end portion of the link plate 24. This pivoting end portion of the link plate 24 and the pivoting end portion of the driven gear 23 are connected to each other by means of a bolt 29 threadingly engaged with the weld nut 28 in such a manner as to clamp the driven gear 23 therebetween.

Figure 10:
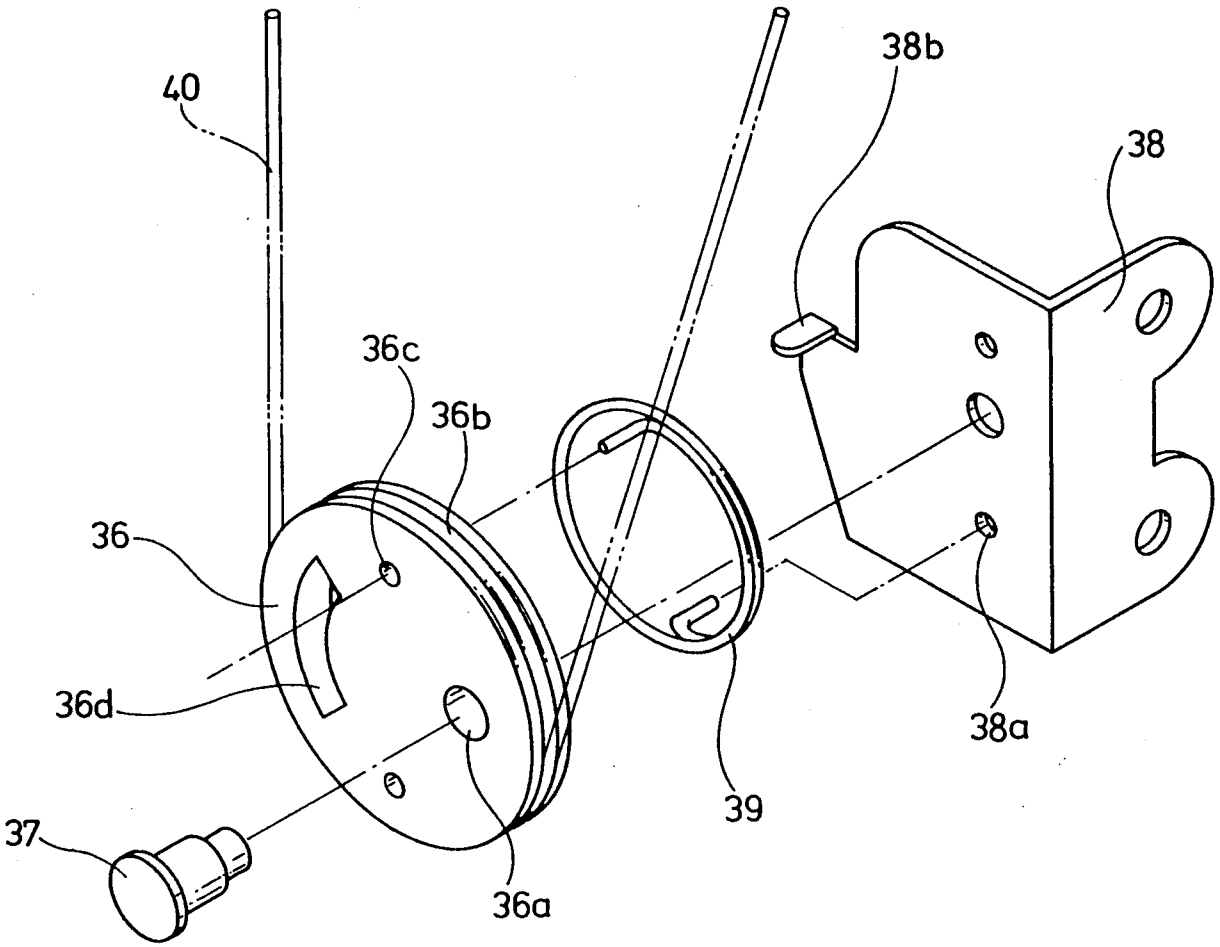
FIG. 10 is a exploded perspective view illustrating the guide pulley system.

Referring now to FIG. 2 and FIGS. 8–10, a description will be given of a mechanism for adjusting the vertical position of the hip support. In these drawings, two vertically extending slots 27a, 27b are provided within the support plate 27. A support board 30 is attached to the support plate 27 and is designed to press or engage the occupant's hip region, that is, the lumbar vertebrae, L-3 to L-5. This support board 30 is provided with guide rollers 31, 32 respectively disposed within in the two slots 27a, 27b so as to guide the support board 30 vertically. Drum brackets 34, 35 are disposed upon an upper portion of the side of the support plate 27 which is opposite to the side upon which the support board 30 is provided, the drum brackets 34, 35 being adapted to rotatably support a drum 33. In addition, a guide pulley bracket 38 is provided upon a lower portion of the support plate 27 upon the same side thereof as are disposed the drum brackets 34, 35. As shown in FIG. 10, a guide pulley 36 in the form of a circular disk is pivotably mounted upon the guide pulley bracket 38 by means of a pin 37 in an eccentric state. A bore 36a for insertion of the pin 37 is provided within the guide pulley 36 at an eccentric position thereof, and an annular groove 36b is provided around an outer peripheral portion thereof. A torsion spring 39 has one end portion retained by means of a bore 38a provided within the guide pulley bracket 38 and the other end portion retained by means of a bore 36c formed within the guide pulley 36. As a result, the guide pulley 36 is biased in the direction in which the tension of a cable 40 increases. In addition, the guide pulley 36 is provided with a circular arc-shaped guide bore 36d, a projection 38b formed upon the guide pulley bracket 38 being fitted within this guide bore 36d. By virtue of this fitting, the guide pulley 36 is adapted to be capable of pivoting within the range defined by means of the projection 38b as the same abuts against the opposite end surfaces of the guide bore 36d.

The opposite end portions of the cable 40 are wound around the drum 33 and retained thereat, and an intermediate portion is attached to the support board 30 and is wound around the groove 36b of the guide pulley 36.

In addition, an inner handle shaft 41 is rotatably disposed within the outer handle shaft 19 in such a manner as to be rotatable and axially movable with respect thereto. The first operation handle 4a is attached to one end portion of the inner handle shaft 41 by means of a screw 42 in such a manner as to project axially outwardly from the second operation handle 4b. Attached to the other end portion of the inner handle shaft 41 is one end of a flexible wire 43. The other end portion of this flexible wire 43 is connected to an unillustrated shaft of the drum 33. A spring 44 is provided between the first operation handle 4a and the second operation handle 4b and is adapted away from urge the first operation handle 4a in a direction to the side frame 5.

The operation of the above-described arrangement will be described hereinunder. A description will first be given of a case where the hip support 3 is moved back and forth by using the second operation handle 4b. FIGS. 2 and 3 illustrate a state in which the pinion 20 abuts the non-gear portion 23b of the driven gear 23, and the hip support 3 is accommodated within the innermost portion of the space 2a of the seat back 2. In this state, if the second operation handle 4b is rotated so as to cause the pinion 20 to rotate clockwise, as viewed in FIG. 3, by means of the brake mechanism 12, the driven gear 23 meshing with the pinion 20 rotates counterclockwise, as viewed in FIG. 3. In conjunction with the rotation of the driven gear 23, the link plate 24 with its pivoting end portion connected to the driven gear 23 also rotates counterclockwise, as viewed in FIG. 3, about the shaft 22. As the link plate 24 pivots, the rod 25 secured to the link plate 24 also rotates counterclockwise, as viewed in FIG. 3, which, in turn, causes the support plate 27 to pivotally move in the direction of projecting outwardly from the seat back 2, thereby causing the hip support 3 to project outwardly from the space 2a of the seat back 2 in the forward direction. This movement is allowed until the stopper arm 24a of the link plate 24 is brought into contact with the side surface of the baseplate 7, that is, until the driven gear 23 moves to the position indicated by means the two-dotted chain line in FIG. 3. It is further appreciated that if the second operation handle 4b is rotated in the opposite direction, that is, counterclockwise, the hip support 3 returns to the innermost position of adjusted space 2a of the seat back 2. The back-and-forth position of the hip support 3 is therefore maintained by virtue of the action of the above-described brake mechanism 12, and in particular, due to the interaction of the spring 17 and the inner peripheral wall of the brake housing 16, unless the second operation handle 4b is operated.

A description will be given hereinunder of a case where the support board 30 is moved vertically by using the first operation handle 4a. If the first operation handle 4a is rotated, this rotation is transmitted to the drum 33 by means of the flexible wire 43. Upon rotation of the drum 33, the cable 40 moves vertically, and the support board 30 attached to the cable 40 moves verticaly as a result of being guided by means of the interaction defined between the rollers 31, 32 and the slots 27a, 27b. The vertical position of the support board 30 is thus adjusted.

In accordance with the above-described arrangement, as the occupant of a vehicle operates the first and second operation handles 4a, 4b while being seated, the position of the hip support 3 can be adjusted in both back and forth and vertical modes. Moreover, since back-and-forth adjustment and vertical adjustment are respectively effected steplessly by means of engagement between the pinion 20 and the driven gear 23 and the rotation of the drum 33, it is possible for the occupant to receive support of his hip region with a desired strength and at a desired part of his body.

Furthermore, in the above-described embodiment, since the first and second operation handles 4a, 4b are provided upon the same axis, the operating efficiency is good. In addition, at the time of handling the second operation handle 4b, since the first operation handle 4a can be pressed by the palm of the hand so as to be moved in the direction toward the side frame 5, the second operation handle 4b can be grabbed securely. Moreover, in terms of their external appearance, the two operation handles look as if they are one handle, so that an attractive appearance can be obtained.

It should be noted that the present invention is not confined to the above-described embodiments, and various modifications are possible without departing from the spirit of the invention which is defined solely by the accompanying claims.

What is claimed is:

1. A seat, comprising:

a seat cushion;

a seat back connected to said seat cushion, a space being formed within a lower portion of said seat back;

a rod rotatably interposed between oppositely disposed side frames of said seat back;

a hip support secured upon an intermediate portion of said rod and disposed within said space provided within said seat back;

a support board disposed upon a support plate provided within said hip support in such a manner as to be vertically movable along said support plate in order to engage different lumbar regions of a person seated within said seat;

first operation handle means operatively connected to said support board for moving said support board upwardly and downwardly along said support plate; and second operation handle means for rotating said rod by means of a brake mechanism so as to move said hip support in a forward and backward mode relative to said space defined within said seat back.

2. A seat according to claim 1, wherein said brake mechanism is attached to one of said side frames of said seat back by means of a baseplate.

3. A seat according to claim 1, wherein said brake mechanism comprises:

a brake housing;

a torsion spring disposed inside said brake housing in such a manner as to be brought into pressure contact with an inner wall of said brake housing;

a core driven by a handle of said second operation handle means and provided with a notch, said core being rotatably inserted inside said torsion spring; and a stopper plate having a pawl portion inserted and disposed inside the space of said notch of said core between hook portions of said torsion spring in such a manner as to be rotatable about a handle shaft of said handle of said second operation handle means.

4. A seat according to claim 3, wherein the rotation of said second operation handle is transmitted to said support plate by means an outer handle shaft, said brake mechanism in which said core is connected to said outer handle shaft, a pinion connected to said stopper plate of said brake mechanism, a driven gear meshing with said pinion, a link plate rotatively driven by said driven gear, and said rod connected to said link plate.

5. A seat as set forth in claim 4, wherein:

said driven geat is a sector gear.

6. A seat as set forth in claim 4, wherein:

said link plate has a projecting end portion for engaging a base plate, upon which said brake mechanism is mounted and which in turn is mounted upon one of said side frames of said seat back, so as to limit the movement of said hip support in said forward mode relative to said space defined within said back seat.

7. A seat according to claim 4, wherein the rotation of a first operation handle of said first operation handle means is transmitted to said drum by means of an inner handle shaft rotatably disposed within said outer handle shaft and a flexible wire attached to said inner handle shaft.

8. A seat as set forth in claim 7, wherein:

said first and second operation handles, and said inner and outer handle shafts, are co-axially disposed with respect to each other.

9. A seat as set forth in claim 7, wherein:

said first and second operation handles are disposed at a position which is external to a side portion of said seat back of said seat so as to be accessible to said person seated within said seat.

10. A seat as set forth in claim 1, wherein said first operation handle means comprises:

a drum rotatably mounted upon an upper portion of said support plate;

a guide pulley rotatably mounted upon a lower portion of said support plate; and a cable, having opposite end portions thereof engaged with said drum and said guide pulley, and a substantially intermediate portion fixedly connected to said support board, so as to vertically move said support board upon said support plate as a result of rotatable movement of said drum.

11. A seat as set forth in claim 10, further comprising:

bracket means for rotatably mounting said guide pulley upon said support plate in an eccentric manner about an axis eccentric to a central axis of said guide pulley;

means defined between said guide pulley and said bracket means for limiting the rotation of said guide pulley about said eccentric axis to within a predetermined angular range corresponding to said vertical movement of said support board upon said support plate; and torsion spring means interposed between said bracket means and said guide pulley for biasing said guide pulley in a predetermined direction tending to increase the tension of said cable.

12. A seat as set forth in claim 11, wherein said means defined between said guide pulley and said bracket means for limiting said range of rotation of said guide pulley, comprises:

an arcuate slot defined within said guide pulley; and a tab projecting outwardly from said bracket means and disposed within said arcuate slot of said guide pulley so as to encounter opposite ends of said arcuate slot and thereby limit said range of rotation of said guide pulley.

13. A seat as set forth in claim 1, wherein:

said support plate has a plurality of vertical slots defined therein; and said support board has a respective plurality of roller means disposed within said slots of said support plate for cooperating with said slots in order to provide said vertical movement of said support board along said support plate.

* * * * *